US005208527A

United States Patent [19]

Poletto et al.

[11] Patent Number: 5,208,527

[45] Date of Patent: May 4, 1993

[54] REFERENCE VOLTAGE GENERATOR WITH PROGRAMMABLE THERMAL DRIFT

[75] Inventors: Vanni Poletto, Camino; Massimiliano Brambilla, Sesto S. Giovanni, both of Italy

[73] Assignee: SGS-Thomson Microelectronics S.r.l., Milan, Italy

[21] Appl. No.: 811,261

[22] Filed: Dec. 19, 1991

[30] Foreign Application Priority Data

Dec. 21, 1990 [IT] Italy ..... 22470 A/90

[51] Int. Cl.[5] ..... G05F 3/30

[52] U.S. Cl. ..... 323/313; 323/907; 307/296.1; 307/296.6

[58] Field of Search ..... 323/312, 313, 314, 315, 323/907; 307/296.1, 296.6, 296.7

[56] References Cited

U.S. PATENT DOCUMENTS 5,001,414 3/1991 Brambilla et al. ..... 323/313

*Primary Examiner*—Emanuel T. Voeltz

*Attorney, Agent, or Firm*—Seed and Berry

[57] ABSTRACT

The generator comprises a first generator of voltage with thermal drift of zero, a second generator of voltage with given thermal drift, first means for applying a given load to the voltage generated by the first generator, second means for applying a given load to the voltage generated by the second generator, subtracting means for subtracting one from the other the loaded voltages generated by said first and second generator of voltage.

16 Claims, 1 Drawing Sheet

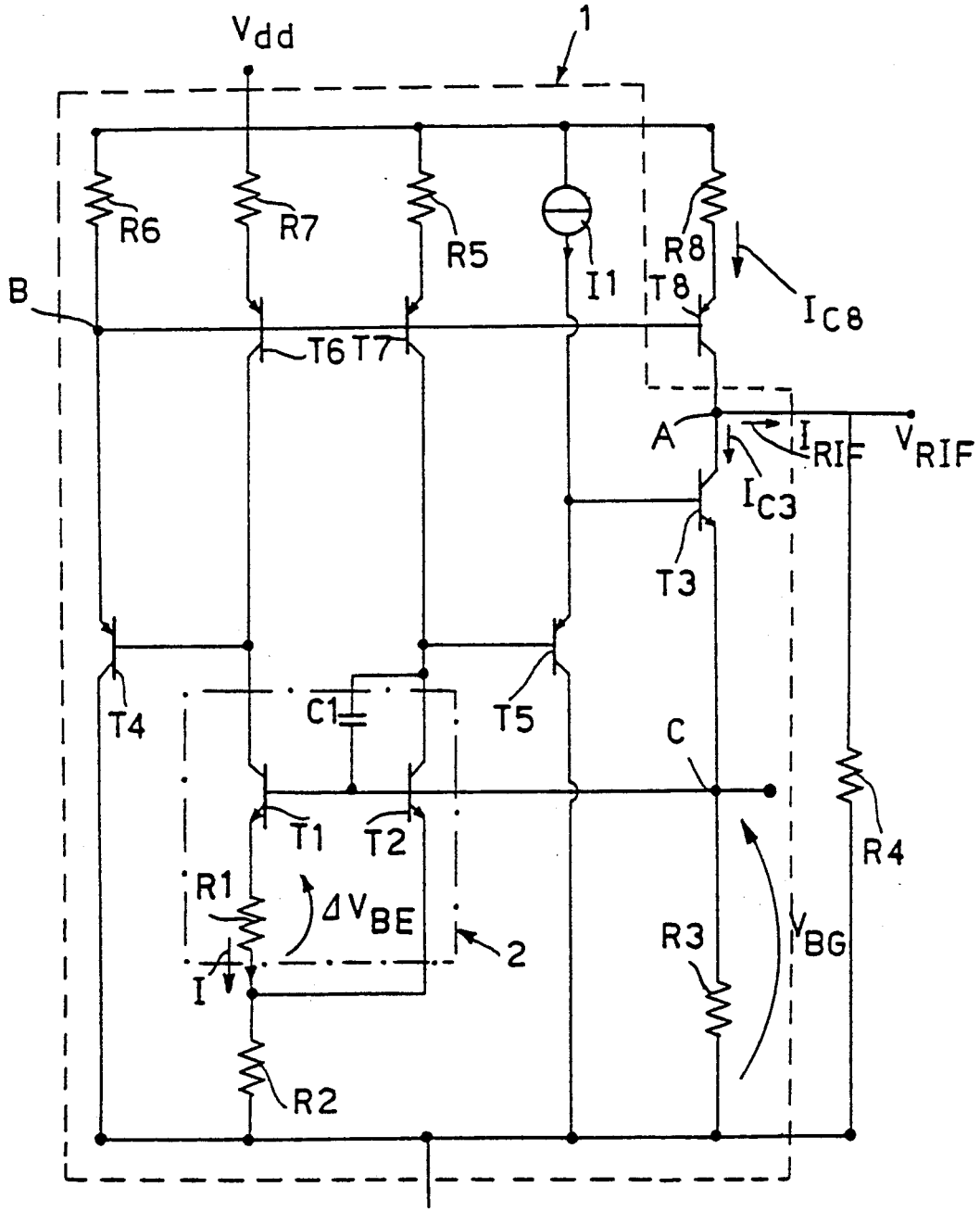
Vdd
1
R6
R7
R5
I1
R8
T8
IC8
B
T6
T7
A
IRIF
VRIF
IC3
T3
T4
C1
T5
C
T1
T2
R4
R1
ΔVBE
2
R3
VBG
I
R2

REFERENCE VOLTAGE GENERATOR WITH PROGRAMMABLE THERMAL DRIFT

DESCRIPTION

The present invention relates to a reference voltage generator with programmable thermal drift.

The need is known of having available a voltage generator whose reference voltage is capable of tracking with a high degree of accuracy the voltage drop across a resistance in a temperature interval ranging from −40° C. to +150° C.

Let us in fact suppose that we wish to verify the current flowing through a load. A circuit that accomplishes such an operation provides for the presence of a comparator which at one input is supplied with a reference voltage and at the other input is supplied with a voltage present across a detection resistance arranged in series with the load with the interposition of a switch. A control circuit operated by the output of the comparator opens the switch every time the voltage across the detection resistance is higher than the reference voltage. It is thus possible to calculate the current flowing through the detection resistance and thus the current through the load.

It is evidently important to accomplish a reference voltage generator having a heat coefficient that is identical to that of the detection resistance, so that it is possible to read the value of the current in the load with the same degree of accuracy at all temperatures.

According to the known art such a generator is accomplished through a circuit comprising a so-called bandgap reference generator (as described in the book "Analogue Integrated Circuits, Analysis and Design", Paul R. Gray and Robert Meyer, chapter 4, paragraph A 4.3.2.), that has extremely low thermal drift, and a series of two diodes connected between the output of the bandgap generator and a bias resistance. Across the bias resistance there is then taken a reference voltage, obtained as the difference between the bandgap voltage and the sum of the voltages across the diodes, that has a heat coefficient that is substantially the same as that of the abovementioned detection resistance.

The known art has some drawbacks. In it the reference voltage is given by the expression $V_{REF}=V_{BG}-2V_d$, where $V_{REF}$ is the reference voltage, $V_{BG}$ is the bandgap voltage and $V_d$ is the diode voltage.

Analysing the two left-hand terms of the expression it is possible to see that as far as the bandgap voltage $V_{BG}$ is concerned the error introduced by the variations of its absolute value and connected with the different processing steps is not negligible and it is thus necessary to control the voltage $V_{BG}$ by means of calibrations that require undesirably high silicon areas.

In addition the heat coefficient of the voltage $V_d$ is a function of the absolute value of the same, which depends logarithmically on the absolute value of the operating current and is subject to variations as a result of mass production processes.

On the basis of these considerations it can be deduced that it is impossible with this art to obtain a high degree of accuracy of the absolute value of the reference voltage $V_{REF}$ and in particular of its heat coefficient.

The object of the present invention is that of obtaining a reference voltage generator with thermal drift that can be selected in a continuous range of values, that has a high degree of accuracy and a very small size.

According to the invention such object is attained with a generator of a reference voltage, characterized in that it comprises a first generator of voltage with thermal drift of zero, a second generator of voltage with given thermal drift, first means for applying a given load to the voltage generated by the first generator, second means for applying a given load to the voltage generated by the second generator, subtracting means for subtracting one from the other the loaded voltages generated by said first and second generator of voltage.

Preferably, the second generator of the voltage is included inside the first and has in common with it two NPN transistors with bases connected together and with emitters connected together through a resistance and to ground through a further common resistance, said transistors having different emitter areas.

The voltage with thermal drift of zero and the voltage with given thermal drift are applied across respective resistances and said subtracting means comprise a circuit node in which said respective resistances converge together with an output resistance for the generation of said reference voltage.

The features of the present invention shall be made more evident by an embodiment illustrated as a non-limiting example in the only FIGURE of the enclosed drawing.

With reference to the illustrated figure, the circuit as a whole comprises a resistance R6 interposed between a power supply $V_{dd}$ and the emitter of a transistor T4 of the type PNP. The collector of the transistor T4 is grounded, the base is connected to the collector of a transistor T6 of the PNP. The latter, together with transistors T7, T8 of the type PNP and with respective emitter resistances R7, R5, R8 connected to the supply voltage $V_{dd}$, constitutes a current mirror. The bases of the transistors T6, T7, T8 are connected to an intermediate node B between the resistance R6 and the transistor T4 so that they are biased. The collectors of the transistors T6, T7 are connected to respective collectors of two transistors T1, T2 of the type NPN with different emitter area (that of T1 equal to n times that of T2). The base of the transistor T1 is connected to the base of the transistor T2. The emitters of the two transistors T1, T2 are connected together through a resistance R1. A capacity C1 is interposed between the base and the collector of the transistor T2. Taken as a whole the transistors T1, T2 together with the resistance R1 constitute generating means 2 of a current I which, due to the effect of the presence of the abovementioned current mirror, is taken back on the emitter and thus on the collector of the transistor T8 as current $I_{C8}$. The circuit also comprises a transistor T5 of the type PNP, whose base is connected to the collector of the transistor T7. The collector of the transistor T5 is grounded, the emitter is supplied by the current of a current generator I1 connected to the voltage $V_{dd}$ and to the base of a transistor T3 of the type NPN. To a circuit node A interposed between the collector of the transistor T8 and the collector of the transistor T3 there is connected a resistance R4 which is grounded at its other extremity. The reference voltage $V_{REF}$ is taken across it. The emitter of the transistor T3 is connected to ground through a resistance R3, which has the function of setting the operating current of the transistor T3. Across the resistance R3, between an intermediate node C connected to the base of the transistors T1, T2 and ground, there is a bandgap voltage $V_{BG}$, that is generated by the circuit unit indicated with 1 and that has thermal drift equal to zero as it is originated as the sum of a component having negative thermal drift (base-emitter voltage) of T2) and of a component having positive thermal drift (voltage across R2, function of the difference between the base-emitter voltages of the two transistors T1 and T2 having different emitter area).

The circuit described operates as follows.

Applying Kirchoff's equation to the mesh formed by the transistors T1, T2 and by the resistance R1 there is obtained that across the resistance R1 there is a voltage $V_{BE}$ equal to the difference between the base-emitter voltages of the transistors T2 and T1 and thus with given constant thermal drift. In the resistance R1 there flows a current I equal to $V_{BE}$/R1. This current, due to the effect of the current mirror 4, is taken back as current $I_{C8}$ on the emitter of the transistors T8 and thus, in the hypothesis that the base current of the transistor T8 is negligible, on the collector of the transistor T8. On the emitter of the transistor T3 there is a current given by the ratio between the voltage $V_{BG}$ across the resistance R3 and the resistance R3 itself. It follows that, applying Kirchoff's law to the intermediate node A between the collectors of the transistors T8 and T3, it is obtained that the current through the resistance R4 is given by the difference between the collector current $I_{C8}$ on the collector of the transistor T8 and the collector current $I_{C3}$ on the collector of the transistor T3. The reference voltage $K_{REF}$ is thus given by the expression:

$$V_{REF} = R4(V\Delta V_{BE}/R1 - V_{BG}/R3) \quad (1)$$

Assuming $$R3 = KR1 \quad (2)$$

we get $$V_{REF} = R4/R1(\Delta V_{BE} - V_{BG}/K) = R4/R1(V\Delta V_{BE} - Vo) \quad (3)$$

where $$V_{BG}/K = Vo \quad (4)$$

In order to be able to assess the dependence on temperature of equation (3), it is necessary to express the dependence of the individual terms: '$\Delta V_{Be}$ starting from the equation that expresses the voltage difference $V_{BE}$ between the two transistors T1, T2, it is possible to write:

$$DV_{BE}=nV_T Ln(I_{C1}/I_{S1})(I_{C2}/I_{S2}) \quad (5)$$

where $V_T$ is the voltage equivalent of the temperature defined by the relation $V_T=kT/q$ (k=Boltzmann's constant, T=absolute temperature, q=electronic charge) and on the basis of Einstein's equation it is given by the ratio between diffusion and electronic mobility.

If $I_{C1}=I_{C2}$ $I_{S1}=AI_{S2}$ with $I_{C1}$, $I_{C2}$ equal to the collector currents of the transistors T1, T2, $I_{S1}$, $I_{S2}$ saturation currents of the transistors T1, T2 and A the ratio between the emitter areas of the transistors T1, T2 we get:

$$\Delta V_{BE}=nV_T LnA=nkT/qLnA \quad (6)$$

where:

T=absolute temperature k=Boltzmann's constant q=electron charge n=technological parameter independent of temperature.

Equation 6 can also be written:

$$V_{BE}=n(kTo/q)(LnA+n(k(T-To)/q)LnA \quad (7)$$

with To=reference temperature.

Carrying on, from equation 7 we get:

$$V_{BE}=n(kTo/q)(1+(T-To)/\mathrm{To})LnA=\Delta V_{BEO}(1-+\alpha DT)n \quad (8)$$

Equation 8 highlights the law of variation of the voltage $\Delta V_{BE}$ as a function of temperature with:

$\Delta V_{BEO}$=value calculated at the reference temperature;

$\alpha$=heat coefficient $$\alpha=1/To(1/°K) \quad (9)$$

$$\alpha=10^6/To(ppm/°K) \quad (10)$$

$-V_{BG}$/K:

it is assumed as a first approximation that the voltage $V_{BG}$ is independent of temperature;

−R4/R1:

if the two resistances are coupled, their ratio is independent of temperature.

Substituting in equation 3 we get:

$$V_{REF}=R4/R1(\Delta V_{BEO}(1+\alpha DT)-Vo) \quad (11)$$

$$V_{REF}=R4/R1(\Delta V_{BEO}-Vo)(1+\alpha' DT)) \quad (12)$$

where:

$$\alpha'=\Delta V_{BEO}/(\Delta V_{BEO}-Vo))\alpha \quad (13)$$

Equation 12 identifies a voltage with linear thermal drift, wherein the value of the heat coefficient depends on the absolute value of the voltage Vo and thus of the voltage $V_{BG}$:

$$Vo=\Delta V_{BEO}(1-\alpha/\alpha') \quad (14)$$

This determines the possibility of selecting the value of the heat coefficient on the basis of one's requirements, with a high degree of accuracy and with no need for calibrations.

We claim:

1. Reference voltage generator, characterised in that it comprises a first generator of voltage with thermal drift of zero, a second generator of voltage with given thermal drift, first means for applying a given load to the voltage generated by the first generator, second means for applying a given load to the voltage generated by the second generator, subtracting means for subtracting one from the other the loaded voltages generated by said first and second generator of voltage.

2. Reference voltage generator according to claim 1, characterised in that said second generator of voltage is included inside said first generator and comprises two transistors of the type NPN with bases connected together and with emitters connected together through a resistance and to ground through a further common resistance, said transistors having different emitter areas.

3. Generator according to claim 1, characterised in that said voltage with thermal drift of zero and said voltage with given thermal drift are applied across respective resistances and said subtracting means comprise a circuit node in which said respective resistances converge together with an output resistance for the generation of said reference voltage.

4. A voltage generator outputting a reference voltage with a selected thermal drift comprising:

a first voltage generator with a thermal drift of approximately zero so that the output voltage of said first generator is approximately constant with changes in temperature;

a second voltage generator having a selected thermal drift so that the output voltage of said second generator varies with the temperature in a known manner;

a first load applied to the voltage of said first voltage generator so as to have an approximately constant current with temperature;

a second load applied to the voltage of said second voltage generator so as to have a varying current with temperature; and a voltage divider circuit including said first load and said second load coupled to an output node to output a reference voltage at the node between said first and second loads having a desired thermal drift.

5. The circuit according to claim 4 wherein said second voltage generator includes a first pair of two bipolar transistor having their bases coupled together and emitter areas having a selected ratio with respect to each other.

6. The circuit according to claim 5 wherein the ratio of the emitter areas of the two bipolar transistors determines the thermal drift of said second voltage generator with temperature.

7. The circuit according to claim 4, further including mirroring resistor coupled to the second voltage generator for having a current therethrough that varies with temperature so that the voltage drop across said mirroring resistor varies with temperature.

8. The circuit according to claim 7 wherein said mirroring resistor is part of said voltage divider circuit.

9. The circuit according to claim 4 wherein said first and second loads within said voltage divider circuit each includes a resistor in series with a bipolar transistor.

10. The circuit according to claim 4, further including an output resistor coupled to said output node, the current through said output resistor being the difference between the current through said first load and the current through said second load for producing a voltage drop across the output resistor that is proportional the difference between the current flow through said first load and the current flow through said second load.

11. The circuit according to claim 9 wherein a base of said transistor in said second load is coupled to the base of a second pair of transistors that have their respective outputs coupled to the respective collectors of to a first pair of bipolar transistors, said first pair of bipolar transistors having their bases coupled together.

12. The circuit according to claim 11 wherein the ratio of the area of the emitters of said first pair of bipolar transistors is equal to a selected value to provide the selected thermal drift.

13. The circuit according to claim 11 wherein said second pair of transistors are PNP bipolar transistors and their collectors are the outputs connected the respective collectors of said first pair, said first pair being NPN transistors.

14. The circuit according to claim 10 wherein said output resistor is coupled between respective collectors of two transistors within said first and second load, one of said transistors being an NPN and the other being a PNP.

15. The circuit according to claim 4 wherein the voltage of said second voltage generator is applied across said second load by a current mirroring circuit that is equal to a current flow within said second voltage generator for applying said second voltage to said second load.

16. The circuit according to claim 4 wherein said voltage with approximately zero thermal drift is a bandgap voltage generated as the sum of a component having negative thermal drift and a component having positive thermal drift.

* * * * *

UNITED STATES PATENT AND TRADEMARK OFFICE

CERTIFICATE OF CORRECTION

PATENT NO. : 5,208,527

DATED : May 4, 1993

INVENTOR(S) : Vanni Poletto and Massimiliano Brambilla

It is certified that error appears in the above-indentified patent and that said Letters Patent is hereby corrected as shown below:

Column 6, Claim 13, line 27, after "connected" and before "the respective", please insert --to--.

Signed and Sealed this

Fourth Day of January, 1994

Bruce Lehman

*Attest:*

BRUCE LEHMAN

*Attesting Officer*

*Commissioner of Patents and Trademarks*

US005208527B1

REEXAMINATION CERTIFICATE (3281th)

United States Patent [19] [11] B1 5,208,527

Poletto et al. [45] Certificate Issued Jul. 22, 1997

[54] REFERENCE VOLTAGE GENERATOR WITH PROGRAMMABLE THERMAL DRIFT

[75] Inventors: Vanni Poletto, Camino; Massimiliano Brambilla, Sesto S. Giovanni, both of Italy

[73] Assignee: SGS-Thomson Microelectronics S.r.l., Agrate Brianza, Italy

Reexamination Request:
No. 90/003,891, Jun. 23, 1995

Reexamination Certificate for:

| | |
|---|---|
| Patent No.: | **5,208,527** |
| Issued: | **May 4, 1993** |
| Appl. No.: | **811,261** |
| Filed: | **Dec. 19, 1991** |

[51] Int. Cl.[6] ..... G05F 2/16

[52] U.S. Cl. ..... 323/313; 323/907; 327/530; 327/538

[58] Field of Search ..... 323/312, 313, 323/314, 315, 907; 327/530, 534, 535, 538, 542

[56] References Cited

U.S. PATENT DOCUMENTS

| | | | |
|---|---|---|---|
| 4,628,247 | 12/1986 | Rossetti | 323/314 |
| 4,789,819 | 12/1988 | Nelson | 323/314 |
| 4,792,748 | 12/1988 | Thomas et al. | 323/312 |
| 5,001,414 | 3/1991 | Brambilla et al. | 323/313 |

FOREIGN PATENT DOCUMENTS

| | | | |
|---|---|---|---|
| 264563 | 4/1988 | European Pat. Off. | G05F 3/30 |

*Primary Examiner*—Matthew V. Nguyen

[57] ABSTRACT

The generator comprises a first generator of voltage with thermal drift of zero, a second generator of voltage with given thermal drift, first means for applying a given load to the voltage generated by the first generator, second means for applying a given load to the voltage generated by the second generator, subtracting means for subtracting one from the other the loaded voltages generated by said first and second generator of voltage.

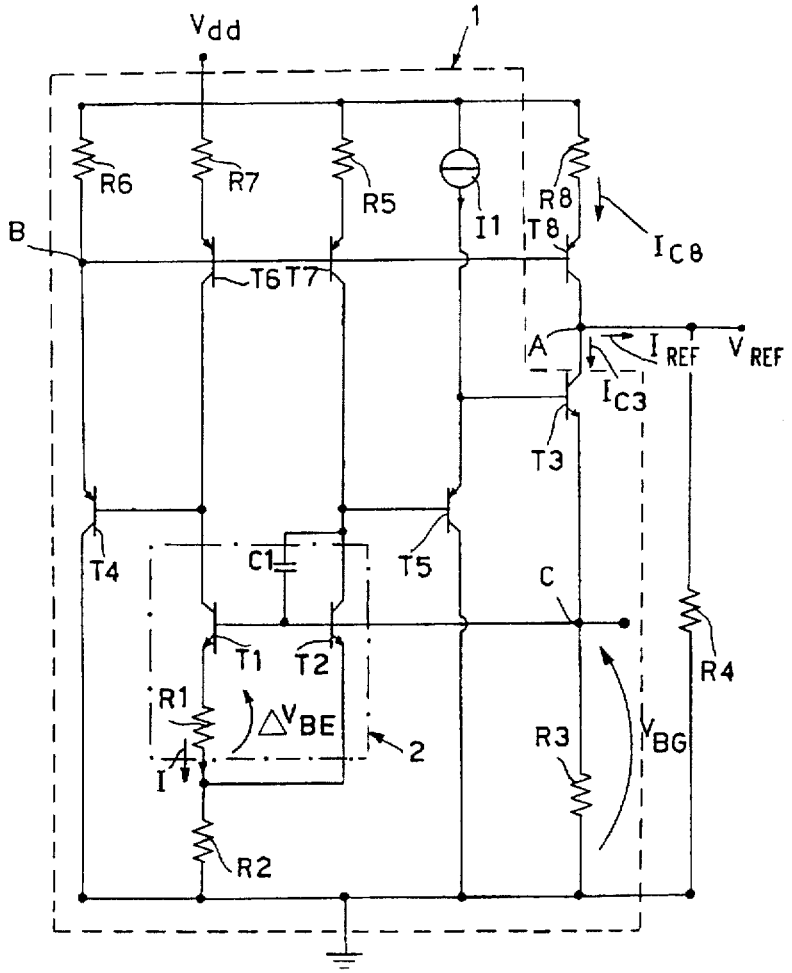

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

THE DRAWING FIGURE HAS BEEN CHANGED AS FOLLOWS:

$I_{RIF}$, $V_{RIF}$ have been changed to $I_{REF}$, $V_{REF}$ respectively, ⊥ has been changed to ⊥, and ΔVBE has been changed to $\Delta V_{BE}$.

AS A RESULT OF REEXAMINATION, IT HAS BEEN DETERMINED THAT:

Claims 1, 2, 4, 7 and 10 are determined to be patentable as amended.

Claims 3, 5, 6, 8, 9 and 11–16, dependent on an amended claim, are determined to be patentable.

1. Reference voltage generator, characterised in that it comprises a first generator of voltage with thermal drift of zero, a second generator of voltage with given thermal drift *formed as an integral portion of said first generator of voltage*, first means for applying a given load to the voltage generated by the first voltage generator, second means for applying a given load to the voltage generated by the second voltage generator, *and* subtracting means for subtracting one from the other the loaded voltages generated by said first and second generator of voltage.

2. Reference voltage generator according to claim 1, characterised in that said *integral portion of said* second generator of voltage [is included inside said first generator and] comprises two transistors of the type NPN with bases connected together and with emitters connected together through a resistance and to ground through a further common resistance, said transistors having different emitter areas.

4. A voltage generator outputting a reference voltage with a selected thermal drift comprising:

a first voltage generator with a thermal drift of approximately zero so that the output voltage of said first generator is approximately constant with changes in temperature;

a second voltage generator having a selected thermal drift so that the output voltage of said second generator varies with the temperature in a known manner, *said second voltage generator including a first resistor*;

a first load applied to the voltage of said first voltage generator so as to have an approximately constant current with temperature;

a second load applied to the voltage of said second voltage generator so as to have a varying current with temperature; [and]

a voltage divider circuit including said first load and said second load coupled to an output node*; and*

*an output resistor coupled to said output node and thermally coupled to said first resistor* to output a reference voltage at [the node between said first and second loads] *said output node whose voltage is dependent on said first resistor and said output resistor and* having a desired thermal drift.

7. The circuit according to claim 4, further including *a* mirroring resistor coupled to the second voltage generator for having a current therethrough that varies with temperature so that the voltage drop across said mirroring resistor varies with temperature.

10. The circuit according to claim 4[, further including an output resistor coupled to said output node,] *wherein* the current through said output resistor [being] *is equal to* the difference between the current through said first load and the current through said second load for producing a voltage drop across [the] *said* output resistor that is proportional *to* the difference between the current flow through said first load and the current flow through said second load.

* * * * *